US006769788B1

(12) United States Patent
Kellough

(10) Patent No.: US 6,769,788 B1
(45) Date of Patent: Aug. 3, 2004

(54) FLASHLIGHT SLEEVE

(76) Inventor: Jeffrey Keith Kellough, 1095 Avocado Crest, La Habra Heights, CA (US) 90631

( * ) Notice: Subject to any disclaimer, the term of this patent is extended or adjusted under 35 U.S.C. 154(b) by 0 days.

(21) Appl. No.: 10/410,414

(22) Filed: Apr. 7, 2003

Related U.S. Application Data

(60) Provisional application No. 60/442,966, filed on Jan. 27, 2003.

(51) Int. Cl.[7] ..... F21L 4/00

(52) U.S. Cl. ..... 362/208; 362/190; 362/389; 362/202

(58) Field of Search ..... 362/202, 208, 362/204, 200, 189, 389, 190; 384/29, 276

(56) References Cited

U.S. PATENT DOCUMENTS

| | | | | | |
|---|---|---|---|---|---|
| 2,244,288 | A | | 6/1941 | Colby | |
| 3,418,461 | A | | 12/1968 | Sedlock | |
| 4,415,954 | A | * | 11/1983 | Schaefer | 362/202 |
| D302,334 | S | | 7/1989 | DeGuevara | |
| 5,016,148 | A | * | 5/1991 | Kohm | 362/102 |
| 5,063,483 | A | | 11/1991 | Feilmeier et al. | |
| D332,500 | S | | 1/1993 | Churchill | |
| 5,226,712 | A | | 7/1993 | Lucas | |
| 5,267,131 | A | * | 11/1993 | Anthony et al. | 362/208 |
| 5,413,414 | A | * | 5/1995 | Bauer | 384/276 |
| 5,473,520 | A | | 12/1995 | Malley | |
| 5,485,357 | A | | 1/1996 | Zolninger | |
| 5,865,542 | A | * | 2/1999 | Ryu | 384/29 |
| 5,947,585 | A | * | 9/1999 | Hill | 362/208 |
| 6,012,824 | A | * | 1/2000 | Sharrah et al. | 362/199 |
| 6,170,787 | B1 | | 1/2001 | Morgan | |
| 6,283,609 | B1 | * | 9/2001 | Parsons et al. | 362/187 |
| 2001/0024367 | A1 | * | 9/2001 | Shiau | 362/188 |

* cited by examiner

*Primary Examiner*—Thomas M. Sember
*Assistant Examiner*—Hargobind S. Sawhney
(74) *Attorney, Agent, or Firm*—Gene Scott-Patent Law & Venture Group

(57) ABSTRACT

A lighting apparatus includes a tubular flashlight with a barrel of a selected size and shape, and a sleeve of uniform cross-section. The sleeve has a through aperture into which the flashlight barrel is engaged with a forward end and a rearward end of the barrel extending from the sleeve. A surface of the aperture has longitudinal resilient ribs. The ribs are of a shape, size, spacing and resiliency as to enable tight gripping of the ribs on the barrel.

6 Claims, 3 Drawing Sheets

FLASHLIGHT SLEEVE

RELATED APPLICATIONS

This application claims priority and is entitled to the filing date of U.S. Provisional application Ser. No. 60/442,966, filed Jan. 27, 2003, and entitled "Device To Allow A Person To Hold A Flashlight In One's Mouth" The contents of the aforementioned application are incorporated by reference herein.

INCORPORATION BY REFERENCE: Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to flashlights and fixture for use with the mouth, especially for use in holding objects in the mouth, and more particularly to a sleeve adapted for holding a flashlight by the mouth.

2. Description of Related Art

The following art defines the present state of this field:

Churchill, U.S. Des. Pat. No. 332,500 describes a mouth supported flashlight design DeGuevara, U.S. Des. Pat. No. 302,334 describes a mouth supported holder for a flashlight design.

Colby, U.S. Pat. No. 2,244,288 describes A flashlight holder comprising a cap, a threaded lining of current conducting material in the cap and adapted to be screwed on one end portion of a flashlight for removably mounting said cap thereon, an integral, substantially T-shaped bit projecting longitudinally from the cap, said bit adapted to be gripped between the teeth, and an integral brace depending from the cap and engageable with the chin for assisting in supporting the flashlight in a forwardly projecting position. The brace provides an opening for the reception of a support for hanging the flashlight.

Sedlock, U.S. Pat. No. 3,418,461 describes a flashlight embodying an elongated barrel-like battery containing casing having an illuminable lens at a forward end and a closing cap at a rearward end, and self-contained readily applicable and removable flashlight positioning, supporting and light beam directing attachment means embodying an adapter clamp comprising a resilient hand-type C-clamp snugly but yieldingly and adjustably embracing a portion of said casing adjacent said rearward end, a complemental support bracket, said bracket being generally L-shaped in edge elevation and embodying companion legs disposed at right angles to each other, one leg being of a predetermined length, width and crosssectional dimension and having a right angularly bent free end portion arcuately bent and superimposed upon and affixed to a median crest potion of the outer peripheral surface of the bight portion of said C-clamp whereby said one leg is radial to and flush with a rearward marginal edge of said clamp, the other leg being at right angles to said one leg and adapted to assume a plane parallel to the longitudinal axis of said casing and being wholly and protectively enclosed in a permanently attached compressibly resilient sleeve, and said sleeve being formed at an outer free end portion with an enlarged retaining anti-slipping bead fashioned into and providing a contoured conveniently grippable mouthpiece which when in use is adapted to be clenched and held between the user's teeth.

Feilmeier, et al., U.S. Pat. No. 5,063,483 describes a battery powered light with mouthpiece including the combination of an illuminating means and a mouthpiece. In use, a user can hold the illuminating means by gripping the mouthpiece and direct the light source in a particular manner. The combination of an illuminating means and a mouthpiece permits the illuminating means to be used while the hands of a user are free to perform specific tasks.

Lucas, U.S. Pat. No. 5,226,712 describes A flashlight having a main body with a light emitting source at a distal end thereof powered by a battery power source within the main body and a switch at an opposite proximal end encapsulated within a resilient switch jacket defining an oral grasping portion adapted to be held between a user's upper and lower front teeth such that a biting force exerted thereon serves to operate the switch between an open position and a closed position. The proximal end of the main body is sized and configured to prevent accidental, forced entry of the flashlight into the user's oral cavity during use. A neck strap attached at opposite ends to the main body allows the flashlight to be hung about the user's neck in a readily accessible orientation.

Malley, U.S. Pat. No. 5,473,520 describes a flashlight holding mouthpiece, which consists of a receptacle portion adapted to grippingly embrace the rear end of an associated miniature flashlight and an outwardly projecting flange portion, the entire mouthpiece, including the receptacle portion and the flange portion, being a unitary body of resilient material. In a first embodiment of the invention the flange portion is small enough to be received between the user's teeth and lips. In the second preferred embodiment the flange portion is large enough to protect the user's lips from coming in contact with the metal barrel of the miniature flashlight.

Zolninger, U.S. Pat. No. 5,485,357 describes a flashlight with mouth support and associated controls including a flashlight having a forward end with a bulb, a rearward end with a separable cap with a spherical recess and an intermediate cylindrical extent therebetween. A mouthpiece is fabricated of an elastomeric material with an arcuate inner surface adapted to be supported by the teeth of a user and an enlarged external surface positionable between the teeth and lips of the user and a central post extending forwardly thereof. An electrical coupling between the mouthpiece and the flashlight includes a central axial aperture extending from the flashlight to the cap and to an intermediate section of the mouthpiece with electrical wires extending therethrough.

Morgan,. U.S. Pat. No. 6,170,787 describes an expandable cup holder for a golf cart including a support member forming a substantially planar top surface for the cup holder. The support member is fastened to a vehicle with the support member top surface oriented substantially horizontal. The top surface forms a top aperture large enough to receive a plurality of cup sizes. A plurality of flexible fingers are spaced apart from each other around the perimeter of the aperture. The fingers extend conically downwardly toward each other below the top surface, to form a slotted, frustum-shaped member that flexibly contacts and frictionally retains a plurality of cup sizes therein. Front and side walls on the support member surround and support the frustum-shaped member. The front wall includes apertures for retaining golf tees.

The prior art teaches flashlights adapted for being held by mouth and adaptors for being used with a flashlight to enable the flashlight to be held by mouth. The prior art devices teach that a flashlight should be held by its rear end, and all of the adaptations to flashlight cases and all of the flashlight adaptors for holding the flashlight are fixtured at the rear end of the flashlight. In contrast to this teaching, the present invention teaches away; that is, for holding the flashlight medially by the teeth. To accomplish this, the present invention teaches a sleeve that is comfortable to be held by the teeth and adjusts to hold flashlights having a range of sizes, in a simple extruded part. The present invention provides these and further related advantages as described in the following summary.

SUMMARY OF THE INVENTION

The present invention teaches certain benefits in construction and use which give rise to the objectives described below.

A lighting device includes a tubular flashlight with a barrel of a size and shape selected from a range of such sizes and shapes, and a sleeve of uniform cross-section. The sleeve has a through aperture into which the flashlight barrel is engaged with a forward end and a rearward end of the barrel extending from the sleeve. An inside surface of the aperture has longitudinal resilient ribs. The ribs are of a shape, size, spacing and resiliency as to enable tight gripping of the ribs on the barrel. The barrel size may be selected from a range of barrel sizes as, when inserted into the sleeve, the ribs are flexible enough to resiliently crush and thereby grip the barrel more securely and enable both small and large barrels to be gripped. In use, the sleeve is place about the barrel of the flashlight and slid to a medial position on the barrel. The flashlight, with the sleeve in place, is then placed into the mouth with the teeth in contact on opposing sides of the sleeve. The sleeve is made of a resilient and orally acceptable material such as latex rubber or the equivalent, and is able to be gripped by the teeth in holding the flashlight. The teeth, in this configuration, are able to aim the flashlight by moving the lower teeth relative to the upper teeth, thereby changing the vertical angle of the flashlight. The head is swiveled to left or right to adjust the position of the flashlight beam between the left and right sides. It should be noted that the present inventive sleeve, when placed on the flashlight barrel allows a rear cap to be removed for changing batteries without separating the flashlight and the sleeve. This is not possible with mouth adaptors that are mounted on the rear end of the flashlight. For such adaptors, they must be separated from the flashlight prior to removing the rear cap.

A primary objective of the present invention is to provide a lighting apparatus and method of use of such lighting apparatus that provides advantages not taught by the prior art.

Another objective is to provide such an invention capable of being held by mouth preferably between the teeth with comfort so as to enable both hands of the user to be free to work.

A further objective is to provide such an invention having a single sleeve capable of accepting a range of flashlight sizes.

A still further objective is to provide such an invention capable of being fabricated at low cost.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
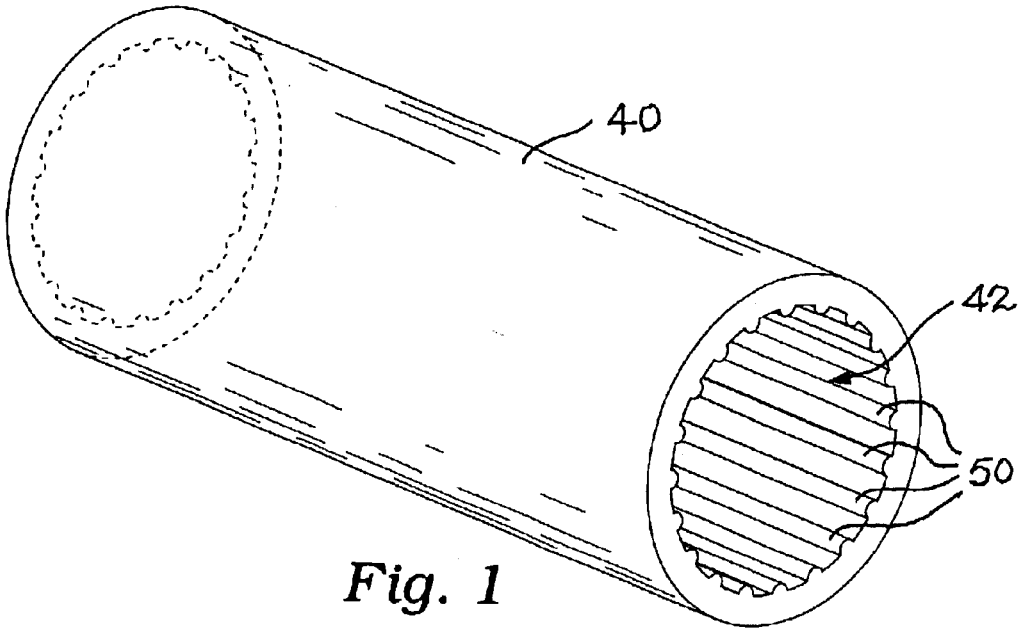
FIG. 1 is a perspective view of a preferred embodiment of the invention.
Figure 2:
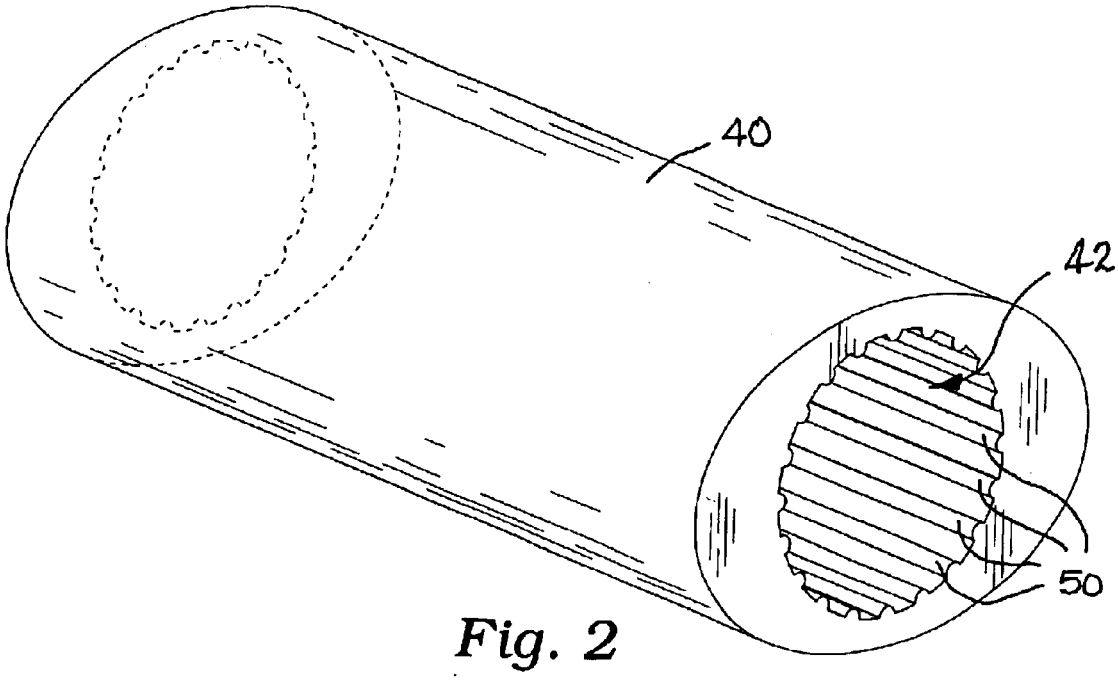
FIG. 2 is a perspective view of a further preferred embodiment of the invention.

The above described drawing figures illustrate the invention in at least one of its preferred embodiments, which is further defined in detail in the following description.

The present invention is a lighting apparatus comprising a tubular flashlight 10, such as those made by MAG Instrument, Inc., 1635 South Sacramento Ave, Ontario, Calif. 91761 U.S.A. Such flashlights 10 have a barrel 20 of a generally uniform diameter and terminate at a forward end 30 with an enlarged diameter portion. Flashlights with tapered barrels 20 and barrels of non-round conformation are also included in the combination of the present invention. The present invention further includes a sleeve 40 of uniform crosssection. The sleeve 40 may be fabricated by the relatively low cost, well known, manufacturing method of plastic extrusion. This provides a significant commercial advantage over prior art devices used for the same end objective. This is accomplished by forcing a molten plastic material through a shaped die and quenching the product as it emerges. In common practice plastic tubes and pipes are made using this process.

The sleeve 40 comprises a through aperture 42 or hole, and the flashlight barrel 20 is engaged therein with both the forward end 30 and a rearward end 30' of the barrel 20 extending from the sleeve 40, i.e., the sleeve 40 is positioned medially on the barrel 20. The surface of the aperture 42 comprises plural longitudinal resilient ribs 50. The ribs 50 are of a shape, size, spacing and resiliency as to enable tight gripping of the ribs 50 on the barrel 20. Because of the ribs resilient nature, the barrel may be selected from a range of barrel diameters, i.e., the ribs 50 are able to be squashed or flattened, by the barrel 20, as it is inserted, with the displaced material (from the flattening) of the ribs 50 moved resiliently aside to spaces between the ribs 50.

Figure 3:
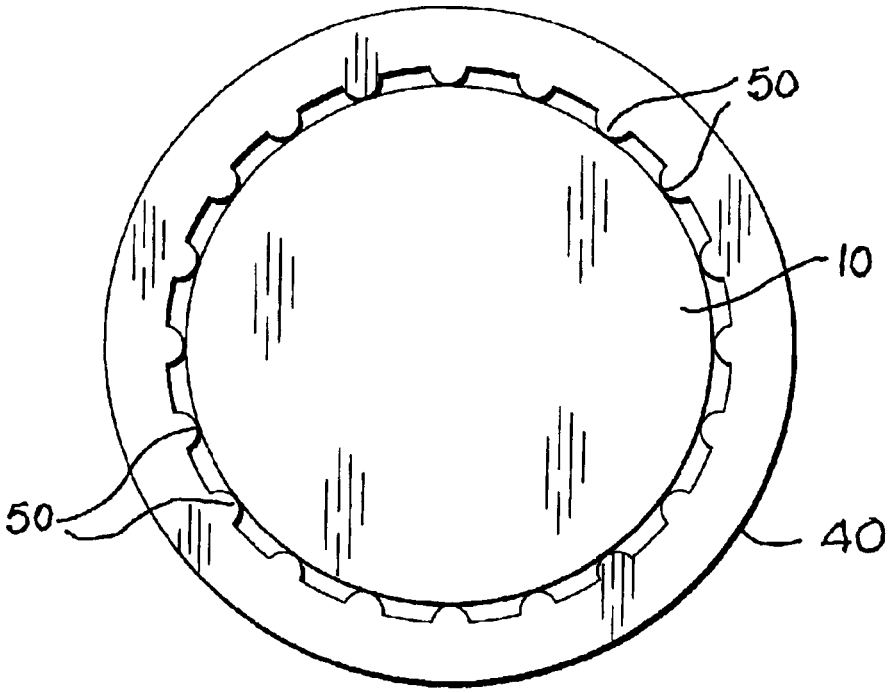
FIG. 3 is an end elevational view of the embodiment of FIG. 1 with a relatively smaller diameter flashlight barrel engaged therein.
Figure 4:
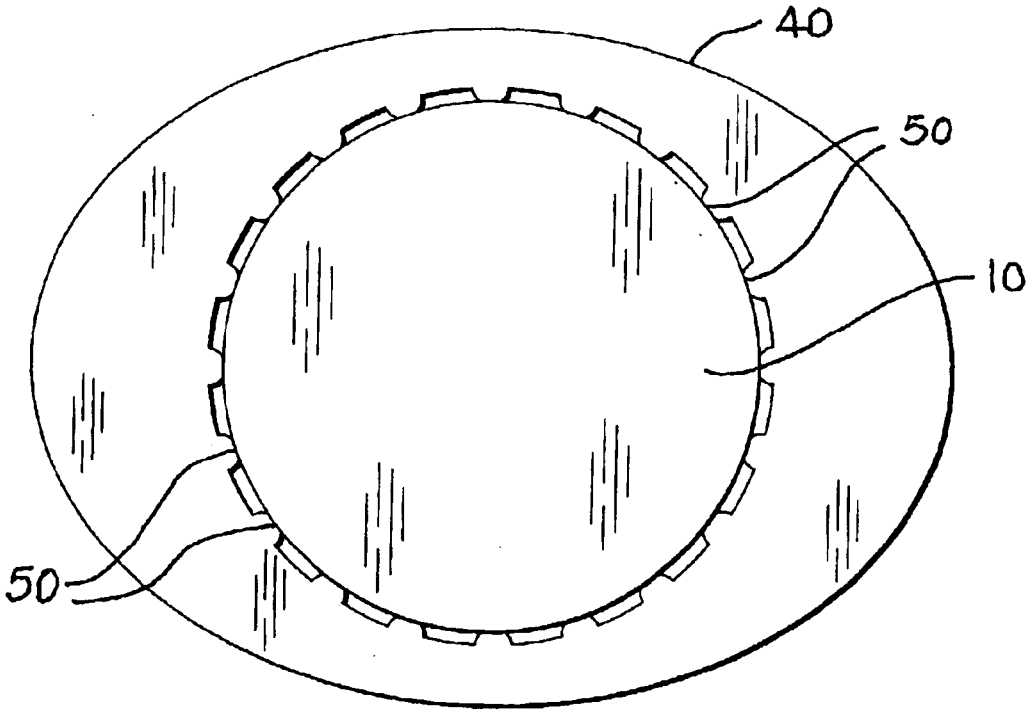
FIG. 4 is an end elevational view of the embodiment of FIG. 2 with a relatively larger diameter flashlight barrel engaged therein.
Figure 5:
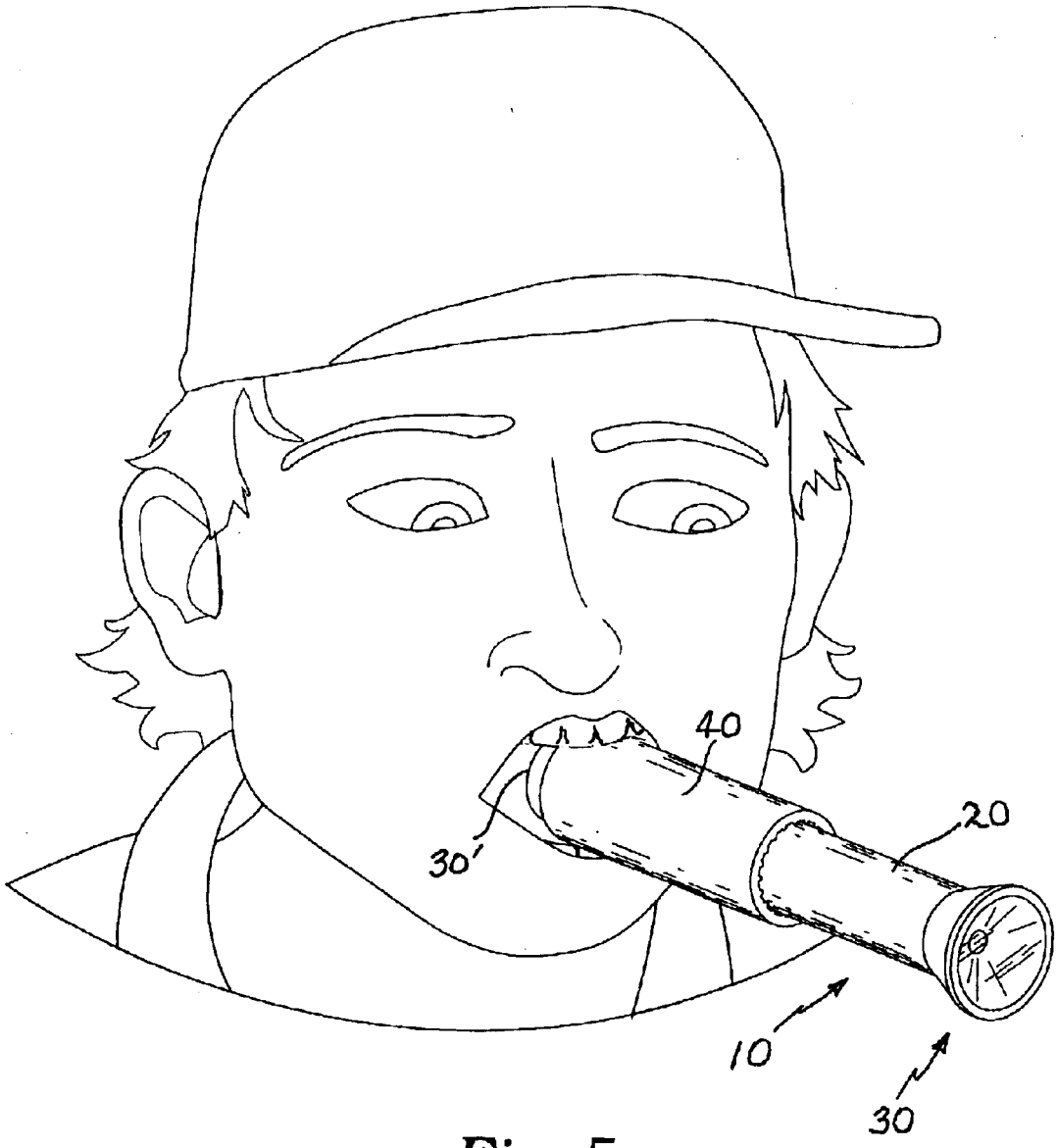
FIG. 5 is a perspective view of the invention in use.

The sleeve 40 may have a circular outer circumference as shown in FIG. 3, but it preferably has an oval outer circumference, as shown in FIG. 4, so that the combination will not roll when placed on a surface. Other non-round shapes, such as square, rectangular, triangular, and so on, may be used to the same advantage.

Preferably, the ribs 50 are semi-circular in cross-sectional shape, and are evenly spaced with a spacing approximately equal to the width of the ribs 50, as best seen in FIG. 3, as this shape and spacing has been demonstrated to grip a range of barrel diameters with superior efficiency over all other shapes/spaces tested. As is well known, different flashlights have diameters of various sizes and shapes, such as round, square, hexagonal, and so on, depending on the manufacturer. The present sleeve 40 is able to securely grip a range of these flashlights due to its resilient ribs and flexible material of construction. Clearly, the ribs 50 may be of alternative shape, size and spacing as may be functional for use with a range of barrel sizes.

Preferably, the entire sleeve 40, not just the ribs 50, is made of a material of such resiliency and flexibility, as is known in the plastic molding industry, as to receive a barrel 20 size selected from a wide range of barrel sizes and shapes by being able to stretch, i.e., the entire sleeve 40 stretches, to fit larger barrel diameters and is of such elastic property as to grip such barrels tightly so that it cannot slide off the barrel.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A lighting apparatus comprising in combination: a tubular flashlight having a barrel; and a resilient sleeve of uniform cross-section, the sleeve comprising a through aperture with the flashlight barrel engaged therein with a forward end and a rearward end of the barrel extending from the sleeve; an internal surface of the aperture comprising longitudinal resilient ribs being semi-circular in shape when not deformed, and having, the ribs of a size, spacing and resiliency enabling tight gripping of the ribs on the barrel, when the barrel size is selected from a range of barrel sizes and shapes.

2. The apparatus of claim 1 wherein the sleeve has a circular outer circumference.

3. The apparatus of claim 1 wherein the sleeve has a non-circular outer circumference.

4. A flashlight adapting apparatus comprising: a resilient sleeve of uniform cross-section, the sleeve comprising a through aperture for receiving a flashlight barrel engaged therein with a forward end and a rearward end of the barrel extending from the sleeve; an internal surface of the aperture comprising longitudinal resilient, semi-circular ribs, the ribs of a size, spacing and resiliency enabling tight gripping of the ribs on the barrel, when the barrel size is selected from a range of barrel sizes.

5. The apparatus of claim 4 wherein the sleeve has a circular outer circumference.

6. The apparatus of claim 4 wherein the sleeve has a non-circular outer circumference.

* * * * *